US009968831B2

(12) United States Patent
Sullivan et al.

(10) Patent No.: US 9,968,831 B2
(45) Date of Patent: May 15, 2018

(54) GOLF BALLS HAVING DUAL CORES MADE OF POLYBUTADIENE RUBBER/IONOMER BLENDS

(71) Applicant: Acushnet Company, Fairhaven, MA (US)

(72) Inventors: Michael J. Sullivan, Old Lyme, CT (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days. days.

(21) Appl. No.: 15/175,244

(22) Filed: Jun. 7, 2016

(65) Prior Publication Data

US 2016/0279485 A1 Sep. 29, 2016

Related U.S. Application Data

(63) Continuation of application No. 14/336,267, filed on Jul. 21, 2014, now Pat. No. 9,364,719, which is a continuation of application No. 13/029,795, filed on Feb. 17, 2011, now Pat. No. 8,784,236, which is a continuation-in-part of application No. 12/819,256, filed on Jun. 21, 2010, now Pat. No. 7,980,965, which is a continuation of application No. 11/972,259, filed on Jan. 10, 2008, now Pat. No. 7,753,810.

(51) Int. Cl.
*A63B 37/06* (2006.01)
*A63B 37/00* (2006.01)

(52) U.S. Cl.
CPC ..... *A63B 37/0092* (2013.01); *A63B 37/0039* (2013.01); *A63B 37/0043* (2013.01); *A63B 37/0047* (2013.01); *A63B 37/0062* (2013.01); *A63B 37/0065* (2013.01); *A63B 37/0066* (2013.01); *A63B 37/0075* (2013.01); *A63B 37/0076* (2013.01); *A63B 37/0091* (2013.01); *A63B 37/0045* (2013.01); *A63B 37/0046* (2013.01); *A63B 37/0064* (2013.01)

(58) Field of Classification Search
CPC ..... A63B 37/0038; A63B 37/0039
USPC ..... 473/373
See application file for complete search history.

(56) References Cited

U.S. PATENT DOCUMENTS

| | | | | |
|---|---|---|---|---|
| 3,421,766 | A | 1/1969 | Chmiel et al. | |
| 4,714,253 | A * | 12/1987 | Nakahara | A63B 37/0003 473/373 |
| 5,772,531 | A | 6/1998 | Ohsumi et al. | |
| 5,820,488 | A | 10/1998 | Sullivan et al. | |
| 5,895,105 | A | 4/1999 | Nesbitt | |
| 6,096,830 | A | 8/2000 | Takemura et al. | |
| 6,290,613 | B1 | 9/2001 | Irii et al. | |
| 6,306,049 | B1 | 10/2001 | Rajagopalan | |
| 6,361,453 | B1 | 3/2002 | Nakamura et al. | |

(Continued)

*Primary Examiner* — Raeann Gorden
(74) *Attorney, Agent, or Firm* — Daniel W. Sullivan

(57) ABSTRACT

A multi-piece golf ball comprising at least one component made of a polybutadiene rubber/ionomer resin blend is provided. The ball preferably contains a dual-core comprising an inner core and surrounding outer core layer. Preferably, the polybutadiene rubber/ionomer resin blend is used to form the outer core layer. Preferably, the outer surface hardness of the outer core layer is greater than the outer surface hardness of the inner core. The resulting ball has high resiliency and good impact durability.

11 Claims, 2 Drawing Sheets

(56) References Cited

U.S. PATENT DOCUMENTS

| | | | | |
|---|---|---|---|---|
| 6,394,915 | B1 | 5/2002 | Nesbitt | |
| 6,565,456 | B2 | 5/2003 | Hayashi et al. | |
| 6,599,983 | B2 | 7/2003 | Irii et al. | |
| 6,613,842 | B2 | 9/2003 | Rajagopalan | |
| 6,624,221 | B2 | 9/2003 | Takesue et al. | |
| 6,634,961 | B2 | 10/2003 | Higuchi et al. | |
| 6,739,985 | B2 | 5/2004 | Nesbitt | |
| 6,756,436 | B2 | 6/2004 | Rajagopalan et al. | |
| 6,767,294 | B2 * | 7/2004 | Nesbitt ..... | A63B 37/0003 473/351 |
| 6,774,187 | B2 | 8/2004 | Voorheis et al. | |
| 6,777,472 | B1 | 8/2004 | Statz et al. | |
| 6,815,480 | B2 | 11/2004 | Statz et al. | |
| 6,852,044 | B2 | 2/2005 | Sullivan et al. | |
| 6,894,098 | B2 | 5/2005 | Rajagopalan et al. | |
| 6,982,301 | B1 | 1/2006 | Voorheis et al. | |
| 7,086,969 | B2 | 8/2006 | Higuchi et al. | |
| 7,148,279 | B2 | 12/2006 | Voorheis et al. | |
| 7,874,939 | B2 | 1/2011 | Sullivan et al. | |

* cited by examiner

GOLF BALLS HAVING DUAL CORES MADE OF POLYBUTADIENE RUBBER/IONOMER BLENDS

CROSS-REFERENCE TO RELATED APPLICATIONS

This application is a continuation of co-assigned U.S. patent application Ser. No. 14/336,267 having a filing date of Jul. 21, 2014, now issued as U.S. Pat. No. 9,364,719 with an issue date of Jun. 14, 2016, which is a continuation of U.S. patent application Ser. No. 13/029,795 having a filing date of Feb. 17, 2011, now U.S. Pat. No. 8,784,236, which is a continuation-in-part of U.S. patent application Ser. No. 12/819,256 having a filing date of Jun. 21, 2010, now U.S. Pat. No. 7,980,965, which is a continuation of U.S. patent application Ser. No. 11/972,259 having a filing date of Jan. 10, 2008, now U.S. Pat. No. 7,753,810, the entire disclosures of which are hereby incorporated by reference.

BACKGROUND OF THE INVENTION

Field of the Invention

The present invention generally relates to multi-piece golf balls and more particularly to golf balls having at least one component made of compositions comprising a polybutadiene rubber/ionomer blend. The golf ball includes an inner core (center) and at least one surrounding core layer. For example, the golf ball may contain a dual-core or multi-layered core comprising an inner core, intermediate core layer, and outer core layer. The golf ball includes a cover of at least one layer, preferably a cover having an inner and outer layer. Preferably, the center hardness of the inner core is greater than the surface hardness of the outer core layer.

Brief Review of the Related Art

Multi-piece solid golf balls having an inner core and outer cover with at least one intermediate layer disposed there between are popular today among professional and recreational golfers. In such balls, the inner core is made commonly of a natural or synthetic rubber, such as polybutadiene, styrene butadiene, polyisoprene, or highly neutralized acid copolymers. Often, the intermediate layer is made of an olefin-based ionomer resin that imparts hardness to the ball. These ionomer acid copolymers contain inter-chain ionic bonding and are generally made of an α-olefin such as ethylene and a vinyl comonomer having an acid group such as methacrylic, acrylic acid, or maleic acid. Metal ions such as sodium, lithium, zinc, and magnesium are used to neutralize the acid groups in the copolymer. Commercially available olefin-based ionomer resins are available in various grades and identified based on the type of base resin, molecular weight, and type of metal ion, amount of acid, degree of neutralization, additives, and other properties. In conventional golf balls, the outer covers are made from a variety of materials including ionomers, polyamides, polyesters, and thermoplastic and thermoset polyurethane and polyureas.

Manufacturers of golf balls use different materials to impart specific properties and features to the ball. For example, the resiliency and rebounding performance of the golf ball is based primarily on the core. The core acts as an "engine" for the ball. In general, the rebounding performance of the ball is based on its initial velocity after being struck by the face of the golf club and its outgoing velocity after making impact with a hard surface. More particularly, the "coefficient of restitution" or "COR" of a golf ball refers to the ratio of a ball's rebound velocity to its initial incoming velocity when the ball is fired out of an air cannon into a rigid vertical plate. The COR for a golf ball is written as a decimal value between zero and one. A golf ball may have different COR values at different initial velocities. The United States Golf Association (USGA) sets limits on the initial velocity of the ball so one objective of golf ball manufacturers is to maximize COR under these conditions. Balls with a higher rebound velocity have a higher COR value. Such golf balls rebound faster, retain more total energy when struck with a club, and have longer flight distance.

Golf balls containing multi-layered cores are generally known. For example, Sullivan et al., U.S. Pat. No. 6,852,044 discloses a multi-layered core golf ball that comprises a center, a cover and at least two core layers formed around the center to create an inner ball, wherein the outermost core layer is relatively stiff and hard relative to the center. One outermost core layer is heavily filled with a density increasing material and at least one core layer functions as a moisture vapor barrier layer. Ohsumi et al., U.S. Pat. No. 5,772,531 discloses a golf ball comprising a solid core having a three-layered structure composed of an inner layer, an intermediate layer, and an outer layer, and a cover for coating the solid core. The intermediate layer is designed to have a JIS-C hardness of 50 to 80, and the outer layer is designed to have a hardness which is higher than the hardness of the intermediate layer.

One objective of the present invention is to develop compositions that can be used to make a highly resilient core for a golf ball. The ball also should have high durability and impact strength. The present invention provides golf ball compositions having such properties as well as other advantageous characteristics, features, and benefits.

SUMMARY OF THE INVENTION

The present invention provides a multi-piece golf ball comprising at least one component made of a polybutadiene rubber/ionomer resin blend. In one embodiment, the ball contains a dual-core comprising an inner core (center) and surrounding outer core layer. The inner core has a geometric center and outer surface, while the outer core layer has an inner surface and outer surface. The polybutadiene rubber/ionomer resin blend is used preferably to form the inner core. Preferably, the center hardness of the inner core is greater than the outer surface hardness of the outer core layer. The ball further includes a cover, preferably a dual-cover comprising inner and outer cover layers.

In one preferred embodiment, the specific gravity of the inner core is less than or equal to the specific gravity of the outer core layer. For example, the inner core may have a specific gravity in the range of about 0.50 to about 1.20 g/cc, more particularly in the range of 0.80 to 1.18 g/cc. In one version, the inner core has a specific gravity in the range of about 0.90 to about 1.13 g/cc, and the outer core has a specific gravity in the range of about 1.00 to about 1.18 g/cc.

In one version of the golf ball, the center hardness of the inner core is in the range of about 52 to about 98 Shore C units and the outer surface hardness of the outer core is in the range of about 50 to 96 Shore C units. For example, the center hardness of the inner core and outer surface hardness of the outer core each can be greater than 80 Shore C units. Particularly, in one version, the center hardness of the inner core can be in the range of about 82 to about 96 Shore C units and the surface hardness of the outer core can be in the range of about 81 to about 95 Shore C units. Preferably, the center hardness of the inner core is at least 5 Shore C units greater than the surface hardness of the outer core layer. The outer core layer may be formed from a second rubber composition comprising polybutadiene rubber. The cover is preferably formed of a composition comprising a polymer selected from ionomers, polyesters, polyethers, polyvinyl chlorides, polyvinyl acetates, polycarbonates, polyimides, polyamides, polyurethanes, and polyureas. Preferably, the cover comprises an inner cover layer and outer cover layer, wherein the inner cover layer has a material hardness greater than the surface hardness of the outer cover layer. In one embodiment, the inner cover layer has a material hardness in the range of 80 to 95 Shore C and the outer cover layer has a surface hardness of less than 80 Shore C.

In another embodiment, the golf ball contains a multi-layered core comprising a center made of a rubber composition comprising a blend of polybutadiene rubber and ionomer resin; an intermediate core layer, and an outer core layer, wherein the core has an overall diameter of about 1.40 to about 1.62 inches. Preferably, the center has a surface hardness of 70 Shore C or greater, the intermediate core layer has a surface hardness of less than 80 Shore C, and the outer core layer has a surface hardness of 70 Shore C or greater. The center hardness of the inner core is preferably greater than the outer surface hardness of the outer core layer.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
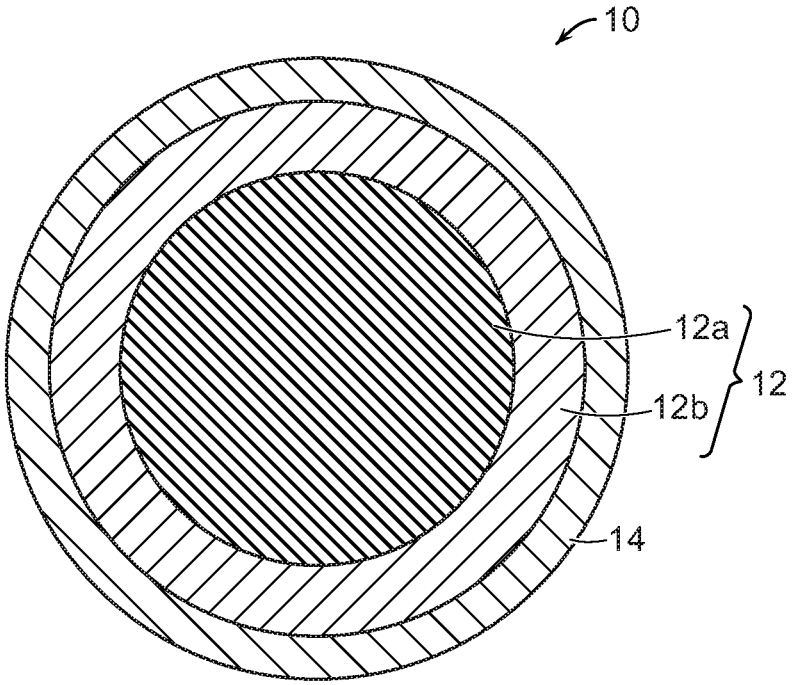
FIG. 1 is a cross-sectional view of a three-piece golf ball having an inner core and outer core layer and a cover, wherein the inner core is made of a polybutadiene rubber/ionomer resin blend.

The present invention relates generally to golf balls containing at least one component made from a composition comprising a blend of polybutadiene rubber and ionomer resin. The golf ball may contain a dual-core comprising an inner core (center) and surrounding outer core layer. In another embodiment, the golf ball may contain a multi-layered core comprising an inner core, intermediate core layer, and outer core layer. Preferably, the inner core is made of a composition comprising a blend of polybutadiene rubber and ionomer resin. In this dual-core construction, the center of the inner core and outer surface of the outer core layer each has a hardness, and the center hardness of the inner core preferably is greater than the outer surface hardness of the outer core layer. The golf ball further comprises a cover disposed about the outer core layer.

Golf balls having various constructions may be made in accordance with this invention. For example, golf balls having three-piece, four-piece, and five-piece constructions with dual or three-layered cores and cover materials may be made The term, "layer" as used herein means generally any spherical portion of the golf ball. More particularly, in one version, a three-piece golf ball having a dual-core (comprising an inner core and outer core layer) and a cover is made. In another version, a four-piece golf ball comprising a "dual-core" and "dual-cover" comprising an inner cover and outer cover is made. In yet another construction, a five-piece golf ball having a dual-core, intermediate layer, and dual-cover is made. As used herein, the term, "intermediate layer" means a layer of the ball disposed between the core and cover. The intermediate layer may be considered an outer core layer, or inner cover layer, or any other layer disposed between the inner core and outer cover of the ball. The intermediate layer also may be referred to as a casing or mantle layer. In accordance with the present invention, at least one of the core, intermediate, and cover layers of the golf ball is formed from the rubber composition of this invention. The diameter and thickness of the different layers along with properties such as hardness and compression may vary depending upon the construction and desired playing performance properties of the golf ball.

Polybutadiene Rubber

The composition of this invention comprises a polybutadiene rubber material. In general, polybutadiene is a homopolymer of 1, 3-butadiene. The double bonds in the 1, 3-butadiene monomer are attacked by catalysts to grow the polymer chain and form a polybutadiene polymer having a desired molecular weight. Any suitable catalyst may be used to synthesize the polybutadiene rubber depending upon the desired properties. Normally, a transition metal complex (for example, neodymium, nickel, or cobalt) or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1, 4 cis-bond content of at least 40%, preferably greater than 80%, and more preferably greater than 90%. In general, polybutadiene rubbers having a high 1, 4 cis-bond content have high tensile strength.

The polybutadiene rubber may have a relatively high or low Mooney viscosity. A "Mooney unit" is an arbitrary unit used to measure the viscosity of raw or unvulcanized rubber. In the present invention, the Mooney viscosity is measured in accordance with "Standard Test Methods for Rubber-Viscosity, Stress Relaxation, and Pre-Vulcanization Characteristics (Mooney Viscometer)" of ASTM D1646-07. In general, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in Voorheis et al., U.S. Pat. Nos. 6,982,301 and 6,774,187, the disclosures of which are hereby incorporated by reference, and used in accordance with the present invention. In general, the lower limit of Mooney viscosity may be 30 or 35 or 40 or 45 or 50 or 55 or 60 or 70 or 75 and the upper limit may be 80 or 85 or 90 or 95 or 100 or 105 or 110 or 115 or 120 or 125 or 130.

The polybutadiene rubber (base rubber) may be blended with other elastomers in accordance with this invention. Other elastomers include, but are not limited to, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

Examples of commercially available polybutadiene rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

The polybutadiene rubber is used in an amount of at least about 5% by weight based on total weight of composition and is generally present in an amount of about 5% to about 60%, or an amount within a range having a lower limit of 5% or 10% or 15% or 20% or 25% or 30% and an upper limit of 35% or 40% or 45% or 50% or 55% or 60%. Preferably, the concentration of polybutadiene rubber is about 10 to about 40 weight percent and more preferably about 15 to about 35 weight percent.

Ionomers

Suitable ionomer resins that may be used in the compositions of this invention are generally referred to as copolymers of α-olefin; $C_3$ to $C_8$ α, β-ethylenically unsaturated mono- or dicarboxylic acid; and optional softening monomer. The α-olefin is preferably ethylene or $C_3$ to $C_8$. These ionomers may be prepared by methods known in the art. Copolymers may include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth) acrylate, ethylene/(meth)acrylic acid/methyl (meth)acrylate, ethylene/(meth)acrylic acid/ethyl (meth)acrylate terpolymers, and the like. The term "copolymer," as used herein, includes polymers having two types of monomers, those having three types of monomers, and those having more than three types of monomers. Preferred α, β-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

When a softening monomer is included, such copolymers are referred to herein as E/X/Y-type copolymers, wherein E is ethylene; X is a $C_3$ to $C_8$ α, β-ethylenically unsaturated mono- or dicarboxylic acid; and Y is a softening monomer. The softening monomer is typically an alkyl (meth) acrylate, wherein the alkyl groups have from 1 to 8 carbon atoms. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene or $C_3$ to $C_6$ α-olefin in the acid copolymer is typically at least 15 wt. %, preferably at least 25 wt. %, more preferably least 40 wt. %, and even more preferably at least 60 wt. %, based on the total weight of the copolymer. The amount of $C_3$ to $C_8$ α, β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on the total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on the total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties. In one version, the ionomer resin preferably contains greater than 5 wt. % acid moieties and more preferably greater than 11 wt. % acid moieties.

The acidic groups in the copolymeric ionomers are partially or totally neutralized with a cation source. Suitable cation sources include metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof. The amount of cation used in the composition is readily determined based on desired level of neutralization. For example, ionomeric resins having acid groups that are neutralized from about 10 percent to about 100 percent may be used. In one embodiment, the acid groups are partially neutralized. That is, the neutralization level is from about 10 to about 80%, more preferably 20 to 70%, and most preferably 30 to 50%. In another embodiment, the acid groups are highly or fully neutralized. That is, the neutralization level is from about 80 to about 100%, more preferably 90 to 100%, and most preferably 95 to 100%.

It is also known that organic acids or salts of organic acids, particularly fatty acids, may be added to the ionomer resin to help make the composition more processable. This may be accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%). The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, and salts of fatty acids, particularly stearic, behenic, erucic, oleic, linoelic or dimerized derivatives thereof. It is preferred that the organic acids and salts be relatively non-migratory (they do not bloom to the surface of the polymer under ambient temperatures) and non-volatile (they do not volatilize at temperatures required for melt-blending).

In one embodiment, a partially or fully neutralized ionomer is added to the polybutadiene rubber. In another embodiment, a blend of lowly or non-neutralized ionomer (for example, ethylene-(meth)acrylic acid copolymer) may be first blended with the polybutadiene rubber in accordance with this invention, followed by neutralization in-situ with a cation source, and optionally fatty acids or fatty acid salts may be added to the mixture.

The amount of ionomer resin added to the polybutadiene rubber is such that the blend contains ionomer an amount of at least about 20% by weight based on total weight of composition and is generally present in an amount of about 20% to about 80%, or an amount within a range having a lower limit of 20% or 30% or 40% or 45% and an upper limit of 50% or 60% or 70% or 80%. Preferably, the concentration of ionomer is at least 40% and more preferably about 40% to about to about 70%.

In the present invention, it has been found that rubber compositions comprising a blend of polybutadiene rubber/ionomer are particularly effective for providing golf balls having high resiliency. Particularly, the rubber compositions can be used to make an inner core (center) that provides the golf ball with good rebounding properties (distance) without sacrificing a nice feel to the ball. The resulting ball has a relatively high COR allowing it to reach high velocity when struck by a golf club. Thus, the ball tends to travel a greater distance which is particularly important for driver shots off the tee. The polybutadiene rubber/ionomer composition helps enhance the hardness and durability of the ball. At the same time, the composition is not excessively hard and it also helps provide the ball with a soft and comfortable. In general, the cores of this invention typically have a COR of about 0.76 or greater; and preferably about 0.80 or greater. The compression of the cores preferably is about 40 or greater; and more preferably in the range of about 50 to about 110. In the present invention, the center hardness of the inner core is preferably greater than the outer surface hardness of the outer core layer. As discussed above, this helps improve the resiliency and carry of the ball. The resulting balls have improved durability and resistance to cracking.

The polybutadiene rubber/ionomer composition may contain other thermoplastic and thermosetting resins including, but not limited to, natural and synthetic rubbers such as polyisoprene, ethylene propylene rubber, ethylene propylene diene rubber, styrene-butadiene rubber, and highly neutralized polymers (HNPs); thermoplastic elastomers, such as polyurethane, poly-ether-ester, poly-amide-ether, polyether-urea, the above-described PEBAX polyetherester elastomers, styrene-butadiene-styrene (SBS) block copolymers, styrene-(ethylene-butylene)-styrene block copolymers, and the like, polyamides (oligomeric and polymeric), polyesters, polyolefins including polyethylene, polypropylene, ethylene/propylene copolymers, and the like, ethylene copolymers with various comonomers, such as vinyl acetate, (meth)acrylates, (meth)acrylic acid, (ethyl)acrylates, (ethyl) acrylic acid, (butyl)acrylates, (butyl)acrylic acid, carbon monoxide, and epoxy-functionalized monomers, polycarbonates, acrylics, such as methyl methacrylate homopolymers or copolymers, polystyrene, polymers functionalized with maleic anhydride, epoxidization, and the like, either by copolymerization or by grafting, elastomers such as EPDM, metallocene catalyzed PE and copolymer, ground-up powders of the thermoset elastomers, and the like.

The polybutadiene rubber and ionomer resin may form a blend, where the polybutadiene rubber is cross-linked, as described further below, and this cross-linked material forms one phase of the blend. The thermoplastic ionomer resin remains essentially not cross-linked and this material forms a second phase of the blend. The resulting blend has properties based on both the polybutadiene rubber and ionomer. If there is any cross-linking in the thermoplastic ionomer material, these bonds are relatively weak and are broken when exposed to high temperatures. As opposed to the thermoplastic ionomer resin, the cross-linking bonds of the thermoset polybutadiene rubber become irreversibly set when cured. The cross-linking bonds are not easily broken when exposed to high temperatures. Thus, the thermoset polybutadiene forms a relatively rigid material. In one embodiment, the polybutadiene rubber may be cured and then the cured composition may be added to the ionomer resin. In another version, the mixture of polybutadiene rubber and ionomer resin may be prepared first and the composition cured subsequently.

Curing of Rubber Composition

The rubber compositions of this invention may be cured, either pre-blending or post-blending, using conventional curing processes. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the total rubber. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

The rubber composition may further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the total rubber.

Radical scavengers such as a halogenated organosulfur, organic disulfide, or inorganic disulfide compounds may be added to the rubber composition. These compounds also may function as "soft and fast agents." As used herein, "soft and fast agent" means any compound or a blend thereof that is capable of making a core: 1) softer (having a lower compression) at a constant "coefficient of restitution" (COR); and/or 2) faster (having a higher COR at equal compression), when compared to a core equivalently prepared without a soft and fast agent. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The rubber compositions of the present invention also may include "fillers," which are added to adjust the density and/or specific gravity of the material. Suitable fillers include, but are not limited to, polymeric or mineral fillers, metal fillers, metal alloy fillers, metal oxide fillers and carbonaceous fillers. Fillers can be in the form of flakes, fibers, fibrils, or powders. Regrind, which is ground, recycled core material (for example, ground to about 30 mesh particle size), can also be used. The amount and type of fillers utilized are governed by the amount and weight of other ingredients in the golf ball, since a maximum golf ball weight of 45.93 g (1.62 ounces) has been established by the United States Golf Association (USGA).

As discussed above, the golf ball preferably contains a dual-core comprising an inner core (center) and surrounding outer core layer. The specific gravity of the center is preferably less than or equal to or substantially the same as the specific gravity of the outer core layer. For purposes of the present invention, specific gravities are substantially the same if they are the same or within 0.1 g/cc of each other. Preferably, the center has a specific gravity within a range having a lower limit of 0.50 or 0.90 or 1.05 or 1.13 g/cc and an upper limit of 1.15 or 1.18 or 1.20 g/cc. The outer core layer preferably has a specific gravity of 1.00 g/cc or greater, or 1.05 g/cc or greater, or 1.10 g/cc or greater. The intermediate core layer preferably has a specific gravity of 1.00 g/cc or greater, or 1.05 g/cc or greater, or 1.10 g/cc or greater. In a particularly preferred embodiment, the specific gravity of the center and that of the outer core layer are substantially the same. In another particularly preferred embodiment, the specific gravity of the intermediate layer and that of the outer core layer are substantially the same.

Suitable polymeric or mineral fillers include, for example, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used.

In addition, the rubber compositions may include antioxidants to prevent the breakdown of the elastomers. Also, processing aids such as high molecular weight organic acids and salts thereof, may be added to the composition. Suitable organic acids are aliphatic organic acids, aromatic organic acids, saturated mono-functional organic acids, unsaturated monofunctional organic acids, multi-unsaturated monofunctional organic acids, and dimerized derivatives thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, dimerized derivatives thereof. The organic acids are aliphatic, mono-functional (saturated, unsaturated, or multi-unsaturated) organic acids. Salts of these organic acids may also be employed. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending.)

Other ingredients such as accelerators (for example, tetra methylthiuram), processing aids, dyes and pigments, wetting agents, surfactants, plasticizers, coloring agents, fluorescent agents, chemical blowing and foaming agents, defoaming agents, stabilizers, softening agents, impact modifiers, antioxidants, antiozonants, as well as other additives known in the art may be added to the rubber composition.

Other additives and fillers include, but are not limited to, chemical blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, tungsten, tungsten carbide, silica, lead silicate, regrind (recycled material), clay, mica, talc, nano-fillers, carbon black, glass flake, milled glass, and mixtures thereof. Suitable additives are more fully described in, for example, Rajagopalan et al., U.S. Patent Application Publication No. 2003/0225197, the entire disclosure of which is hereby incorporated herein by reference. In a particular embodiment, the total amount of additive(s) and filler(s) present in the rubber composition is 15 wt % or less, or 12 wt % or less, or 10 wt % or less, or 9 wt % or less, or 6 wt % or less, or 5 wt % or less, or 4 wt % or less, or 3 wt % or less, based on the total weight of the rubber composition. In a particular aspect of this embodiment, the rubber composition includes filler(s) selected from carbon black, nanoclays (e.g., Cloisite® and Nanofil® nanoclays, commercially available from Southern Clay Products, Inc., and Nanomax® and Nanomer® nanoclays, commercially available from Nanocor, Inc.), talc (e.g., Luzenac HAR® high aspect ratio talcs, commercially available from Luzenac America, Inc.), glass (e.g., glass flake, milled glass, and microglass), mica and mica-based pigments (e.g., Iriodin® pearl luster pigments, commercially available from The Merck Group), and combinations thereof. In a particular embodiment, the rubber composition is modified with organic fiber micropulp, as disclosed, for example, in Chen, U.S. Pat. No. 7,504,448, the entire disclosure of which is hereby incorporated by reference.

Golf Ball Construction

In one preferred embodiment, the core is a dual-core comprising an inner core (center) and a surrounding outer core layer. Preferably, the inner core has a center hardness (CH) within a range having a lower limit of 20 or 25 or 30 or 35 or 40 or 45 or 50 or 55 Shore C and an upper limit of 60 or 65 or 70 or 75 or 80 or 85 or 90 or 95 Shore C. Preferably, the outer core layer has a surface hardness (OCLSH) within a range having a lower limit of 20 or 25 or 30 or 35 or 40 or 45 or 50 or 55 Shore C and an upper limit of 60 or 65 or 70 or 75 or 80 or 85 or 90 or 95 Shore C. More preferably, the center hardness of the inner core is greater than the outer surface hardness of the outer core layer.

In one preferred golf ball, the inner core has a "positive" hardness gradient (that is, the outer surface of the inner core is harder than its geometric center) and the outer core layer has a "positive" hardness gradient (that is, the outer surface of the outer core layer is harder than the inner surface of the outer core layer.) In cases where both the inner core and outer core layer have "positive" hardness gradients, the center hardness of the inner core is still greater than the outer surface hardness of the outer core layer. In one instance, wherein both the inner core and outer core layer each have positive hardness gradients, the hardness of the outer surface of the inner core and hardness of the center of the inner core are both greater than the outer surface hardness of the outer core layer. In other instances, the hardness of the center of the inner core is greater than the outer surface hardness of the outer core layer, but the hardness of the outer surface of the inner core is less than the outer surface hardness of the outer core layer. In another version, the outer core layer has a "negative" hardness gradient (that is, the outer surface of the outer core layer is softer than the inner surface of the outer core layer.) In yet another version, the outer core layer may have a "zero" hardness gradient. (That is, the hardness values of the outer surface of the outer core layer and the inner surface of the outer core layer are substantially the same.) Particularly, the term, "zero hardness gradient" as used herein, means a surface to center (or second surface) Shore C hardness gradient of less than 8, preferably less than 5 and most preferably less than 3 and may have a value of zero or negative 1 to negative 25. The term, "negative hardness gradient" as used herein, means a surface to center (or second surface) Shore C hardness gradient of less than zero. The terms, zero hardness gradient and negative hardness gradient, may be used herein interchangeably to refer to hardness gradients of negative 1 to negative 25. The term, "positive hardness gradient" as used herein, means a surface to center (or second surface) Shore C hardness gradient of 8 or greater, preferably 10 or greater, and most preferably 20 or greater. By the term, "steep positive hardness gradient" as used herein, it is meant surface to center (or second surface) Shore C hardness gradient of 20 or greater, more preferably 25 or greater, and most preferably 30 or greater. For example, the core may have a steep positive hardness gradient of 35, 40, or 45 Shore C or greater.

Preferably, the hardness gradient from the geometric center of the inner core to the surface of the outer core layer is a negative hardness gradient. That is, the outer surface of the outer core layer is softer than the center of the inner core. The hardness gradient from the center of the inner core to the outer surface of the inner core may be positive, negative, or zero; provided, however, that the center hardness of the inner core is still greater than the surface hardness of the outer core layer. Methods for measuring the hardness of the inner core and surrounding layers and determining the hardness gradients are discussed in further detail below.

As discussed above, the dual-core constitutes an inner core (center) and an outer core layer. The inner core preferably has a diameter within a range having a lower limit of 0.75 or 0.85 or 0.875 inches and an upper limit of 1.125 or 1.15 or 1.39 inches. The outer core layer encloses the inner core such that the two-layer core has an overall diameter within a range having a lower limit of 1.40 or 1.50 or 1.51 or 1.52 or 1.525 inches and an upper limit of 1.54 or 1.55 or 1.555 or 1.56 or 1.59 inches.

As discussed above, the inner core preferably has a center hardness of 65 Shore C or greater, or 70 Shore C or greater, or within a range having a lower limit of 55 or 60 or 65 or 70 Shore C or 75 Shore C and an upper limit of 80 or 85 Shore C. And, the outer surface of the outer core layer preferably has a surface hardness of 50 Shore C or greater, or 55 Shore C or greater, or 60 Shore C or greater, or within a range having a lower limit of 50 or 55 or 60 Shore C and an upper limit of 65 or 70 or 80 Shore C. More preferably, the center of the inner core has a hardness of 75 Shore C or greater, or 80 Shore C or greater, or 85 Shore C or greater, or 87 Shore C or greater, or 89 Shore C or greater, or 90 Shore C or greater, or within a range having a lower limit of 75 or 80 or 85 Shore C and an upper limit of 90 or 95 Shore C. And, the outer surface of the outer core preferably has a surface hardness of 65 Shore C or greater, or 70 Shore C or greater, or within a range having a lower limit of 55 or 60 or 65 or 70 Shore C or 75 Shore C and an upper limit of 80 or 85 Shore C.

As discussed above, the polybutadiene rubber/ionomer blend is preferably used to form the inner core ("first rubber composition"). Meanwhile, the outer core layer may be formed from any suitable thermosetting or thermoplastic materials such as, for example, polyurethane, polyurea, partially or fully neutralized ionomers, thermosetting polydiene rubber such as polybutadiene, polyisoprene, ethylene propylene diene monomer rubber, ethylene propylene rubber, natural rubber, balata, butyl rubber, halobutyl rubber, styrene butadiene rubber or any styrenic block copolymer such as styrene ethylene butadiene styrene rubber, and the like, metallocene or other single-site catalyzed polyolefin, polyurethane copolymers, for example, with silicone. In one embodiment, the outer core is formed from a "second rubber composition" comprising a natural or synthetic rubber such as, for example, polybutadiene, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

More particularly, in one embodiment, a polybutadiene rubber/ionomer resin blend is used as the first rubber composition to form the inner core, and a polybutadiene rubber/ionomer blend is used as the second rubber composition to form the outer core layer. The inner core and outer core layer each may have a positive hardness gradient as described above. Alternatively, the inner core and outer core layer each may have a zero or negative hardness gradient. For example, the surface of the outer core layer ("second outer surface") and inner surface of the core layer ("first outer surface") each may have a hardness, the hardness of the second outer surface being in the range of 50 to 85 Shore C units and the hardness of the inner outer surface being in the range of 51 to 86 Shore C units, so that the hardness of the second outer surface is the same or less than the hardness of the first outer surface to define a zero or negative hardness gradient. In another example, the hardness of the second outer surface is in the range of 55 to 95 Shore C units and the hardness of the first outer surface is in the range of 51 to 86 Shore C units, so that the hardness of the second outer surface is greater than the hardness of the first outer surface to define a positive hardness gradient. It should be understood that the inner core and outer core layers may have any combination of positive, negative, and zero hardness gradients; provided, however that the center of the inner core has a hardness greater than the surface hardness of the outer core layer.

In one version, the golf ball includes a multi-layered cover comprising inner and outer cover layers. The inner cover layer is preferably formed from a composition comprising an ionomer or a blend of two or more ionomers that helps impart hardness to the ball. In a particular embodiment, the inner cover layer is formed from a composition comprising a high acid ionomer. A particularly suitable high acid ionomer is Surlyn 8150® (DuPont). Surlyn 8150® is a copolymer of ethylene and methacrylic acid, having an acid content of 19 wt %, which is 45% neutralized with sodium. In another particular embodiment, the inner cover layer is formed from a composition comprising a high acid ionomer and a maleic anhydride-grafted non-ionomeric polymer. A particularly suitable maleic anhydride-grafted polymer is Fusabond 525D® (DuPont). Fusabond 525D® is a maleic anhydride-grafted, metallocene-catalyzed ethylene-butene copolymer having about 0.9 wt % maleic anhydride grafted onto the copolymer. A particularly preferred blend of high acid ionomer and maleic anhydride-grafted polymer is a 84 wt %/16 wt % blend of Surlyn 8150® and Fusabond 525D®. Blends of high acid ionomers with maleic anhydride-grafted polymers are further disclosed, for example, in U.S. Pat. Nos. 6,992,135 and 6,677,401, the entire disclosures of which are hereby incorporated herein by reference.

In one embodiment, the inner cover layer is preferably formed from a composition comprising a 50/45/5 blend of Surlyn® 8940/Surlyn® 9650/Nucrel® 960, and, in a particularly preferred embodiment, has a material hardness of from 80 to 85 Shore C. In another particular embodiment, the inner cover layer is preferably formed from a composition comprising a 50/25/25 blend of Surlyn® 8940/Surlyn® 9650/Surlyn® 9910, preferably having a material hardness of about 90 Shore C. In yet another particular embodiment, the inner cover layer is preferably formed from a composition comprising a 50/50 blend of Surlyn® 8940/Surlyn® 9650, preferably having a material hardness of about 86 Shore C. Surlyn® 8940 is an E/MAA copolymer in which the MAA acid groups have been partially neutralized with sodium ions. Surlyn® 9650 and Surlyn® 9910 are two different grades of E/MAA copolymer in which the MAA acid groups have been partially neutralized with zinc ions. Nucrel® 960 is an E/MAA copolymer resin nominally made with 15 wt % methacrylic acid.

A wide variety of materials may be used for forming the outer cover including, for example, polyurethanes; polyureas; copolymers, blends and hybrids of polyurethane and polyurea; olefin-based copolymer ionomer resins (for example, Surlyn® ionomer resins and DuPont HPF® 1000 and HPF® 2000, commercially available from DuPont; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from DuPont; polyurethane-based thermoplastic elastomers, such as Elastollan®, commercially available from BASF; synthetic or natural vulcanized rubber; and combinations thereof. Castable polyurethanes, polyureas, and hybrids of polyurethanes-polyureas are particularly desirable because these materials can be used to make a golf ball having high resiliency and a soft feel. By the term, "hybrids of polyurethane and polyurea," it is meant to include copolymers and blends thereof.

Polyurethanes, polyureas, and blends, copolymers, and hybrids of polyurethane/polyurea are also particularly suitable for forming cover layers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

The inner cover layer preferably has a material hardness within a range having a lower limit of 70 or 75 or 80 or 82 Shore C and an upper limit of 85 or 86 or 90 or 92 Shore C. The thickness of the intermediate layer is preferably within a range having a lower limit of 0.010 or 0.015 or 0.020 or 0.030 inches and an upper limit of 0.035 or 0.045 or 0.080 or 0.120 inches. The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches. Methods for measuring hardness of the layers in the golf ball are described in further detail below.

As discussed above, the dual-core of this invention may be enclosed with one or more cover layers. In one embodiment, a multi-layered cover comprising inner and outer cover layers is formed, where the inner cover layer has a thickness of about 0.01 inches to about 0.06 inches, more preferably about 0.015 inches to about 0.040 inches, and most preferably about 0.02 inches to about 0.035 inches. In this version, the inner cover layer is formed from a partially- or fully-neutralized ionomer having a Shore D hardness of greater than about 55, more preferably greater than about 60, and most preferably greater than about 65. The outer cover layer, in this embodiment, preferably has a thickness of about 0.015 inches to about 0.055 inches, more preferably about 0.02 inches to about 0.04 inches, and most preferably about 0.025 inches to about 0.035 inches, with a hardness of about Shore D 80 or less, more preferably 70 or less, and most preferably about 60 or less. The inner cover layer is harder than the outer cover layer in this version. A preferred outer cover layer is a castable or reaction injection molded polyurethane, polyurea or copolymer, blend, or hybrid thereof having a Shore D hardness of about 40 to about 50. In another multi-layer cover, dual-core embodiment, the outer cover and inner cover layer materials and thickness are the same but, the hardness range is reversed, that is, the outer cover layer is harder than the inner cover layer.

Figure 2:
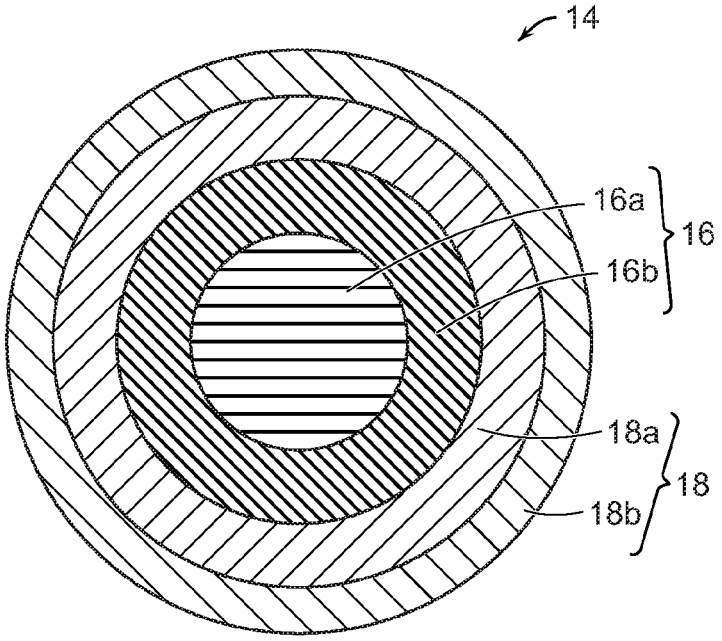
FIG. 2 is a cross-sectional view of a four-piece golf ball having an inner core and outer core layer and a cover comprising inner and outer cover layers, wherein the inner core is made of a polybutadiene rubber/ionomer composition.
Figure 3:
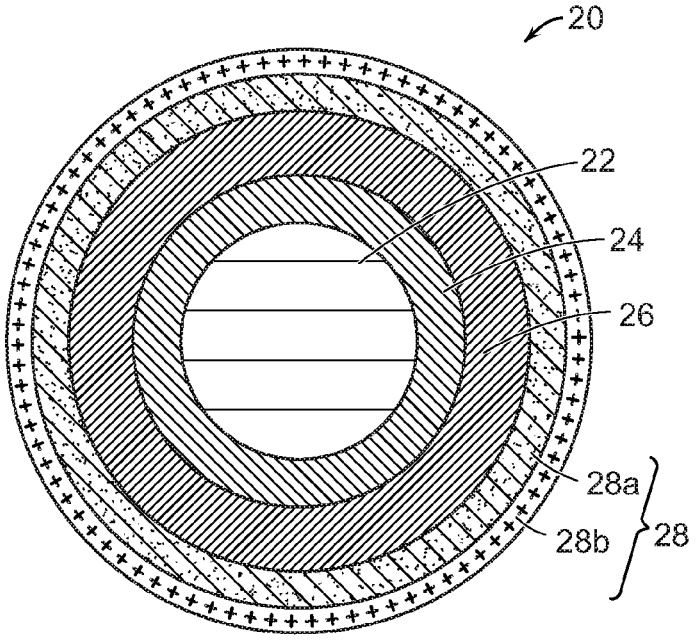
FIG. 3 is a cross-sectional view of a five-piece golf ball having a three layered-core comprising an inner core, intermediate core layer, and outer core and a cover comprising inner and outer cover layers, wherein the inner core is made of a polybutadiene rubber/ionomer composition.

As discussed above, the polybutadiene rubber/ionomer compositions of this invention may be used with any type of ball construction known in the art. Such golf ball designs include, for example, three-piece, four-piece, and five-piece designs. The casing and cover material can be single or multi-layered. Referring to FIG. 1, one version of a golf ball that can be made in accordance with this invention is generally indicated at (10). The ball (10) contains a dual-core (12) having an inner core (center) (12*a*) and outer core layer (12*b*) surrounded by a cover (14). In FIG. 2, another embodiment of a golf ball (14) is shown. The ball (14) contains a dual-core (16) with inner core (16*a*) and outer core layer (16*b*). In addition, the ball (14) includes a dual-cover (18) comprising inner cover (18*a*) and outer cover (18*b*). Turning to FIG. 3 in yet another version, a five-piece golf ball (20) containing a center (22), an intermediate core layer (24), an outer core layer (26) is shown. This ball (14) further includes a dual-cover (28) comprising an inner cover layer (28*a*) and outer cover layer (28*b*).

In the five-piece golf ball (20) shown in FIG. 3, the center core (22) preferably has a diameter within a range having a lower limit of 0.100 or 0.125 or 0.250 inches and an upper limit of 0.375 or 0.500 or 0.750 or 1.00 inches. The intermediate core layer (24) preferably has a thickness within a range having a lower limit of 0.050 or 0.100 or 0.150 or 0.200 inches and an upper limit of 0.300 or 0.350 or 0.400 or 0.500 inches. The outer core layer (26) encloses the center (22) and intermediate core layer (24) such that the multi-layer core has an overall diameter within a range having a lower limit of 1.40 or 1.45 or 1.50 or 1.55 inches and an upper limit of 1.58 or 1.60 or 1.62 or 1.66 inches.

The center (22) preferably has a hardness of 70 Shore C or greater, more preferably a surface hardness of 80 Shore C or greater, and most preferably a surface hardness of 85 Shore C or greater. For example, the center (22) may have a hardness within a range having a lower limit of 70 or 75 or 80 Shore C and an upper limit of 90 or 95 Shore C. The outer core layer (26) preferably has a surface hardness that is less than that of the center and is preferably 70 Shore C or greater, or 80 Shore C or greater, or 85 Shore C or greater. The intermediate core layer (24) preferably has a surface hardness less than that of both the center (22) and outer (26) core layers. Preferably, the intermediate core layer (24) has a surface hardness of less than 70 Shore C, or less than 60 Shore C. As described above, the center (22) is formed preferably from a first rubber composition comprising polybutadiene rubber and ionomer resin such that the hardness of the center (22) is greater than the outer surface hardness of the outer core layer (26). The remaining core layers preferably are formed from a rubber composition (which may also be a blend of polybutadiene rubber and ionomer resin) or from a highly resilient thermoplastic polymer such as highly neutralized polymer ("HNP") compositions as described above.

It should be understood the golf balls shown in FIGS. 1-3 are for illustrative purposes only and are not meant to be restrictive. It should be recognized that other golf ball constructions can be made in accordance with this invention.

Test Methods

Hardness.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

Compression.

As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton. Compression may be measured as described in McNamara et al., U.S. Pat. No. 7,777,871, the disclosure of which is hereby incorporated by reference.

Coefficient of Restitution ("COR").

The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculated as the ratio of the ball's outgoing transit time period to the ball's incoming transit time period ($COR=V_{out}/V_{in}=T_{in}/T_{out}$).

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted.

It is understood that the compositions and golf ball products described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A multi-piece golf ball, comprising:

a dual-core comprising an inner core and outer core layer, the inner core having an outer surface and geometric center and the outer core layer having an outer surface and inner surface; the outer core being formed from a first rubber composition comprising polybutadiene rubber and ionomer resin, wherein the inner core has a center hardness and outer surface hardness, the center hardness being 85 Shore C or greater, and the outer core layer has an inner surface hardness and outer surface hardness, and wherein the center hardness of the inner core is greater than the outer surface hardness of the outer core layer and the outer surface hardness of the inner core is less than the outer surface hardness of the outer core layer; and a cover disposed about the outer core layer.

2. The golf ball of claim 1, wherein the specific gravity of the inner core is less than or equal to the specific gravity of the outer core layer.

3. The golf ball of claim 2, wherein the inner core has a specific gravity in the range of about 0.90 to about 1.13 g/cc, and the outer core has a specific gravity in the range of about 1.00 to about 1.18 g/cc.

4. The golf ball of claim 1, wherein the acid groups of the ionomer resin are neutralized to greater than 70%.

5. The golf ball of claim 4, wherein the acid groups of the ionomer resin are neutralized to greater than 90%.

6. The golf ball of claim 1, wherein the ionomer resin is a E/X/Y copolymer, wherein E is ethylene; X is a $C_3$ to $C_8$ $\alpha,\beta$-ethylenically unsaturated mono- or dicarboxylic acid; and Y is a softening monomer.

7. The golf ball of claim 6, wherein the copolymer is selected from the group consisting of ethylene/(meth)acrylic acid/n-butyl acrylate; ethylene/(meth)acrylic acid/ethyl acrylate; ethylene/(meth)acrylic acid/methyl acrylate; ethylene/(meth)acrylic acid/n-butyl acrylate; and ethylene/(meth) acrylic acid/isobutyl acrylate copolymers.

8. The golf ball of claim 1, wherein the ionomer composition further comprises a fatty acid or salt thereof.

9. The golf ball of claim 1, wherein the inner core layer is formed from a second rubber composition comprising polybutadiene rubber.

10. The golf ball of claim 1, wherein the cover comprises an inner cover layer and outer cover layer.

11. The golf ball of claim 1, wherein the inner and outer cover layers are formed from a composition comprising a polymer selected from the group consisting of partially and fully-neutralized ionomers; polyesters; polyamides; polyamide-ethers, polyamide-esters; polyurethanes, polyureas; fluoropolymers; polystyrenes; polypropylenes and polyethylenes; polyvinyl chlorides; polyvinyl acetates; polycarbonates; polyvinyl alcohols; polyethers; polyimides, polyetherketones, polyamideimides; and mixtures thereof.

* * * * *